US011701288B2

(12) United States Patent
Marti

(10) Patent No.: US 11,701,288 B2
(45) **Date of Patent: *Jul. 18, 2023**

(54) PIVOTING LOWER LIMB THERAPY DEVICE

(71) Applicant: Eduardo Marti, Weston, FL (US)

(72) Inventor: Eduardo Marti, Weston, FL (US)

( * ) Notice: Subject to any disclaimer, the term of this patent is extended or adjusted under 35 U.S.C. 154(b) by 180 days.

This patent is subject to a terminal disclaimer.

(21) Appl. No.: 17/391,112

(22) Filed: Aug. 2, 2021

(65) Prior Publication Data

US 2021/0353491 A1 Nov. 18, 2021

Related U.S. Application Data

(63) Continuation of application No. 16/540,168, filed on Aug. 14, 2019, now Pat. No. 11,083,662.

(51) Int. Cl.

| | |
|---|---|
| ***A61H 1/02*** | (2006.01) |
| ***A63B 21/00*** | (2006.01) |
| ***A63B 21/055*** | (2006.01) |

(52) U.S. Cl.

CPC ..... *A61H 1/024* (2013.01); *A63B 21/00069* (2013.01); *A63B 21/055* (2013.01); *A61H 2201/1269* (2013.01); *A61H 2201/164* (2013.01); *A61H 2201/1635* (2013.01); *A61H 2203/0431* (2013.01); *A61H 2203/0456* (2013.01)

(58) Field of Classification Search

CPC ..... A61H 1/024; A61H 2201/1269; A61H 2201/1635; A61H 2201/164; A61H 2201/1676; A61H 2203/0431; A61H 2203/0456; A63B 21/00069; A63B 21/00185; A63B 21/0023; A63B 21/055; A63B 2208/0233; A63B 2210/02; A63B 2225/09

See application file for complete search history.

(56) References Cited

U.S. PATENT DOCUMENTS 4,844,454 A * 7/1989 Rogers ..... A61H 1/024 482/131
5,236,333 A * 8/1993 Barba, Jr. ..... A61H 1/024 602/5
5,695,434 A * 12/1997 Dalebout ..... A63B 22/0076 482/96

(Continued)

*Primary Examiner* — Joshua Lee

(74) *Attorney, Agent, or Firm* — The Keys Law Firm PLLC

(57) ABSTRACT

A pivoting lower limb therapy device formed from a lever frame having a handle portion integral with its proximal end and a first orthotic portion adjacent to its distal end, a base frame having a second orthotic portion integral with its proximal frame end and a surface support portion integral with its distal frame end, with the lever frame rotatably attached to the base frame so as to permit the first orthotic portion to move across two dimensions relative to the second orthotic portion in response to an exertion of mechanical force on the handle portion. The pivoting lower limb therapy device may also include a strap assembly connected to and extending between the proximal end of the lever frame and the proximal frame end of the base frame so as to exert mechanical force on the two frame members.

11 Claims, 4 Drawing Sheets

(56) References Cited

U.S. PATENT DOCUMENTS

| | | | | |
|---|---|---|---|---|
| 7,309,305 | B2 * | 12/2007 | Nichols | A63B 21/00047 482/148 |
| 9,492,342 | B2 * | 11/2016 | Hall | A61H 1/008 |
| 9,655,803 | B2 * | 5/2017 | Hall | A61H 1/024 |
| 2009/0017995 | A1 * | 1/2009 | Freiberg | A63B 21/00181 482/91 |
| 2011/0224585 | A1 * | 9/2011 | Hall | A61H 1/008 601/34 |
| 2016/0271443 | A1 * | 9/2016 | Malizia | A61H 1/024 |
| 2017/0027799 | A1 * | 2/2017 | Hall | A61H 1/008 |

* cited by examiner

PIVOTING LOWER LIMB THERAPY DEVICE

CROSS REFERENCE TO RELATED APPLICATIONS

This application is a continuation of, claims the benefit of, and incorporates by reference co-pending U.S. patent application Ser. No. 16/540,168 filed Aug. 14, 2019.

BACKGROUND OF THE INVENTION

Field of the Invention

This invention relates to a therapy device for performing rehabilitative activities on a lower limb which allows a user to stretch contracted tissue and increase limb flexion and extension range of motion without assistance from another person.

Description of the Prior Art

Following acute lower limb injuries and/or surgery, it is common for patients to suffer from mechanical limitations in and around their joints. This is generally because when a limb which with a joint is integral is immobilized due to injuries such as a broken bone or splinted after surgery in order to allow a broken bone or surgical site to heal, connective tissue at and/or adjacent to the joint tends to shorten and at times scar up. This often leads to a decrease in range of motion of the joint. And as the length of time of immobilization increases, the magnitude of this condition.

As referred to herein, connective tissue includes ligaments, tendons, joint capsules, and other related structures which are composed of collagenous and reticular fibers, fibrin and ground substance. These components form a mesh-work of attached fibers which are connected throughout the tissue, and the longer the distance between the points of attachment, the greater the range of motion. The attachments can release to prolonged tension, or additional attachments can develop at point of prolonged contact. The length of the fibers between the attachments can also increase or decrease depending on the presence or absence of force.

As the onset of mechanical limitations in and around joints suffered after acute lower limb injuries and/or surgery is substantially unavoidable, physical therapy ("PT") clinics typically provide onsite therapy sessions which allow a patient to perform exercises and stretches designed to improve the functioning of an affected joint with a therapist. Often times, however, therapy sessions are cut short due to a variety of reasons, such as a limited number of treatment sessions approved by insurance companies, lack of transportation, inclement weather, illness, or inability to take days off from work to attend therapy sessions at the clinic.

Due at least in part to the limitations of onsite therapy sessions, there has been significant development of rehabilitation (or "rehab") devices to help provide for or augment rehabilitation efforts. And in order to help a patient regain strength and range of motion to affected joints, it is common for clinicians (e.g. physicians, physical therapists) to prescribe such rehab devices to injured patients. These devices are often considered adjunct home therapy aides and are to be used at home to optimize rehabilitation outcomes and to avoid scar tissue formation in order to eliminate the need for extended rehabilitation at PT or a manipulation under anesthesia. In instances where onsite therapy sessions are limited or unavailable, at-home adjunct devices are critical to helping restore proper health to patient.

At-home adjunct devices that are available today for knee and hip therapy cover a broad spectrum of options. A problem which still exists, however, is that there are two types of motions that are viable, and the devices presently available generally only cover one or the other type of motion.

A first type of motion is passive motion, which is a motion created by an outside force action on the persons limb/joint. A second type of motion is active motion, which is a motion where the patient is supplying the force to move the affected limb on their own. In an onsite therapy session at a PT clinic, a physical therapist may provide both types of motions when they provide therapy to a patient. In fact, a therapist can combine the two types of motion working with a patient. For example, a therapist can hold the limb at a desired flexed position, then asked the patient to activate their muscles, to try to move their limb while the therapist resists. This may be termed as active resistance. Similarly, a therapist may slowly allow the patient to move the limb as the therapist adjusts the tension, allowing movement to occur. This may be termed as isotonic. Moreover, a therapist may allow the patient to move the limb by pushing as hard as they can while the therapist allows the movement to occur at a set speed. This may be termed as isokinetic. Further, a therapist may have the patient push as hard as they can for 10 seconds then release the resistance and allow the patient to move to a different angle and repeat the same 10 second routine. This may be termed as isometric. And a therapist can also have the person try to lightly resist the motion the therapist provides as the therapist moves the limb through a range of motion. This may be termed as eccentric.

Considering these examples of therapeutic actions, the limitations of existing devices and what they are able to provide the patient in terms of normal therapy protocols can be illustrated.

With respect to movement devices, many of the devices for home use for ankles and knees are portable cycling devices. These devices have stands with foot pedals. The patient simply mimics riding a bicycle while sitting on a chair. Some of devices are motorized so that the patient can just relax and let the device rotate and move the limb. This type would be considered passive and not designed to break down scar tissue. The same bicycle type may have a resistance capability whereby a frictional force can make the patient provide more muscle power to turn the pedals, providing active resistance. This is also a type of isotonic motion.

Another class of devices is passive type equipment. Devices used after knee arthroscopic or knee implant surgery are known as continuous passive motion ("CPM") devices. These devices have electronic controllers that can be programmed to move the limb through a set range of motion ("ROM") at a set speed and with a defined force level. These devices are typically rented by the day therefore they are generally utilized for about 14-21 days. Many insurance companies, however, will not pay for a CPM device. Moreover, these devices are not designed to break down scar tissue.

There are a several devices that provide a track with a sliding platform that allow the patient to flex and extend the leg using the track as a guided path and then by turning the track sideways, do hip abduction exercises. This type of device offers little or no resistance and its primary function is to keep joint mobility or maintain ROM between therapy sessions. The slider type device requires the patient to supply the energy to move the limb. This would be considered a low force active exerciser and not designed to break down scar tissue.

Other types of movement devices include standard fitness-gym devices (e.g. leg extension machines). Such devices use weights to resist the movement of a patient's limbs. These types of devices are external devices that are not used to rehabilitate the patients injured knee joint at home and are not designed to break down scar tissue.

With respect to variable locking devices, there are existing devices with turn buckles, screws, or hanging weights on the patient to apply a force on the limb. Some devices use rubber bands and spring tension to apply a dynamic low force worn over a long period of time on the patient's limb. US20120022410 A1 teaches the use of a strap to hold patient's thigh down to the frame in a seated position. Once the strap is placed on thigh the patient inflates an expandable bladder to which increases force on the thigh member in order to achieve extension. U.S. Pat. No. 6,962,570 B2 teaches the use of a series of cables and pulleys the patient pulls on to apply force to the knee while they sit on the frame. This device uses turn buckles to apply pressure to the top of the limb in order to apply a downward force while they sit on the frame. U.S. Pat. No. 6,821,262 teaches the use of a sling type harness to support the ankle and a fulcrum member that sits on thigh and by pulling back on the handle apply pressure on the knee. U.S. Pat. No. 4,114,610 discloses a chair with a U-shaped stirrup you pull and push. U.S. Pat. No. 5,687,742 teaches the use of an elevation pad and knee straps you pull down on to extend leg. And U.S. Pat. No. 9,408,770 B2 discloses a leg extension device that must be lifted up and pulled on the extend the leg. This requires greater upper body strength and some hip flexion capability.

In light of the limitations inherent to onsite therapy session at a PT clinic and to existing devices, there remains a need for a simple safe means to rehabilitate tissue type contractures typically caused by injuries and surgical procedures. Such a device would desirably be simple for the patient to utilize, requiring minimal adjustments to the device for setting up a patient and not employ webbing or hook and loop fasteners which may be difficult to put on or take off. Such a device would further be preferably a self-propelled device and thus completely controlled and operated by the patient.

SUMMARY OF THE INVENTION

The present disclosure provides for a pivoting lower limb therapy device, comprising: a first frame member having a proximal end and a distal end, wherein said first frame member includes a handle portion integral with the proximal end and a first orthotic portion adjacent to the distal end; a second frame member having a proximal frame end and a distal frame end, wherein the second frame member includes a second orthotic portion integral with the proximal frame end and a surface support portion integral with the distal frame end; and wherein said first frame member is movably attached to the second frame member so as to permit the first orthotic portion to move across two dimensions relative to the second orthotic portion in response to an exertion of mechanical force on the handle portion.

Embodiments of the pivoting lower limb therapy device may include a lever frame as the first frame member, with its proximal end formed by a first U-shaped portion, and the first orthotic portion being defined by a cylindrical pad as well as a base frame as the second frame member, with its proximal frame end having a second U shaped portion, and the second orthotic portion being defined by a curved padded member. Embodiments of the pivoting lower limb therapy device may further include a strap assembly connected to and extending between the proximal end of the first frame member and to the proximal frame end of the second frame member so as to exert mechanical force of the two frame members.

DETAILED DESCRIPTION OF THE INVENTION

Figure 1:
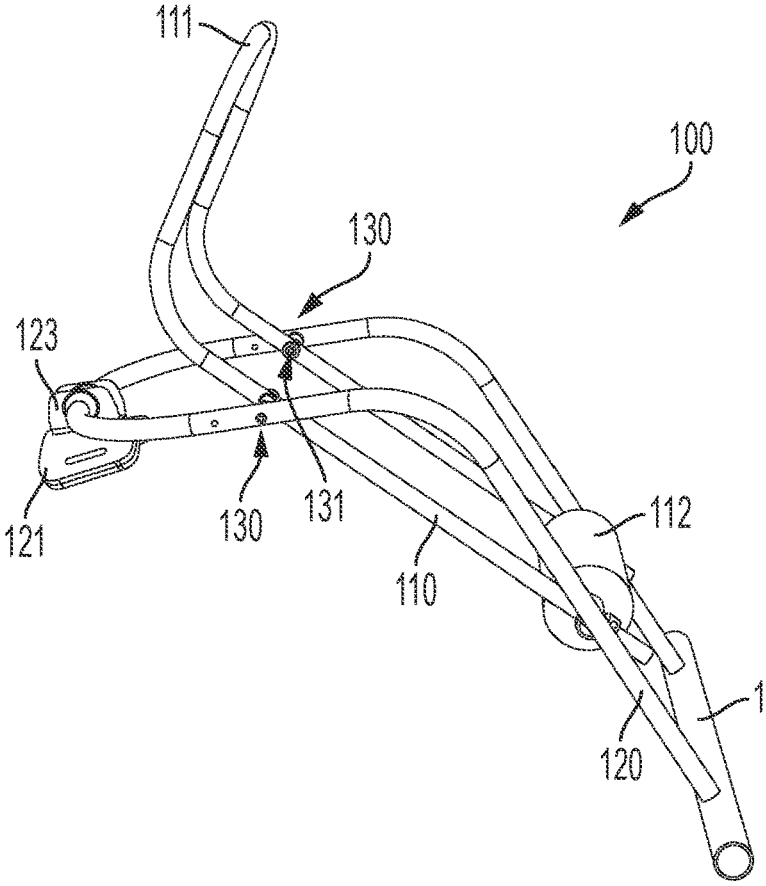
FIG. 1 is a side perspective view of a pivoting lower limb therapy device built in accordance with an embodiment of the present invention shown with its lever frame in a lower position.
Figure 2:
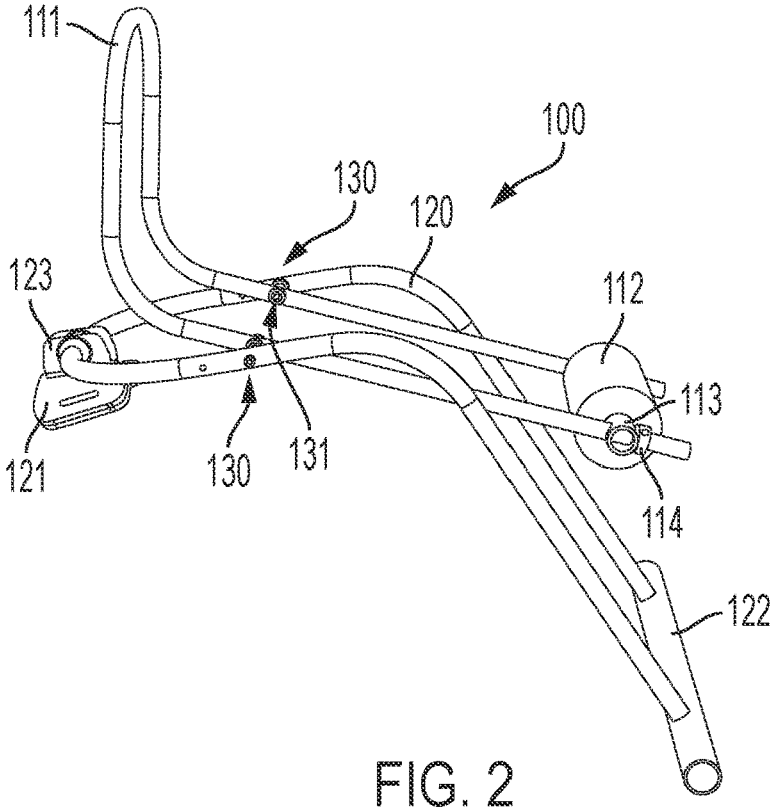
FIG. 2 is a side perspective view of a pivoting lower limb therapy device built in accordance with an embodiment of the present invention shown with its lever frame in a mid position.
Figure 3:
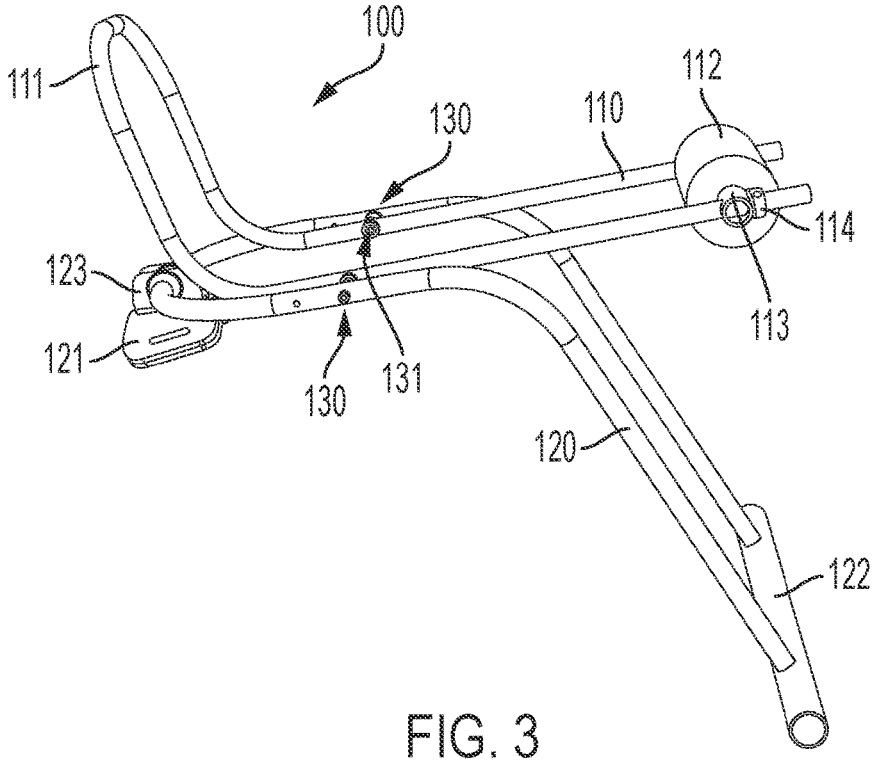
FIG. 3 is a side perspective view of a pivoting lower limb therapy device built in accordance with an embodiment of the present invention shown with its lever frame in an upper position.
Figure 4A:
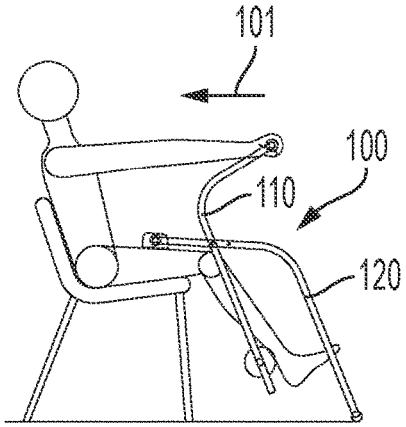
FIG. 4*a* is a side elevational view of a pivoting lower limb therapy device built in accordance with an embodiment of the present invention shown with a seated user and its lever frame in a lower position.
Figure 4B:
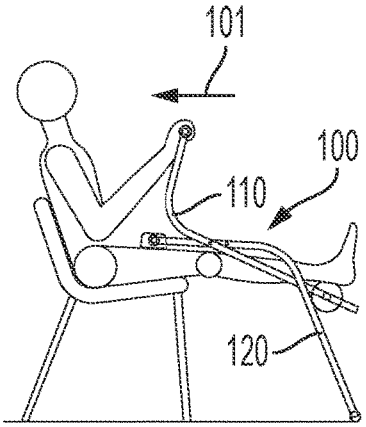
FIG. 4*b* is a side elevational view of a pivoting lower limb therapy device built in accordance with an embodiment of the present invention shown with a seated user and its lever frame in a mid position.
Figure 4C:
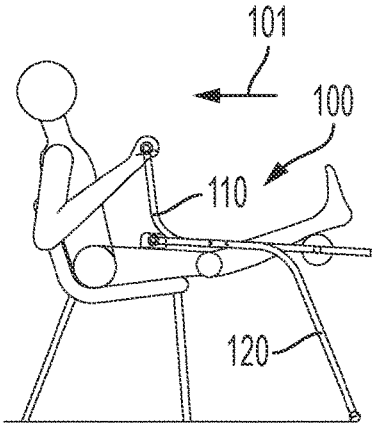
FIG. 4*c* is a side elevational view of a pivoting lower limb therapy device built in accordance with an embodiment of the present invention shown with a seated user and its lever frame in an upper position.
Figure 5:
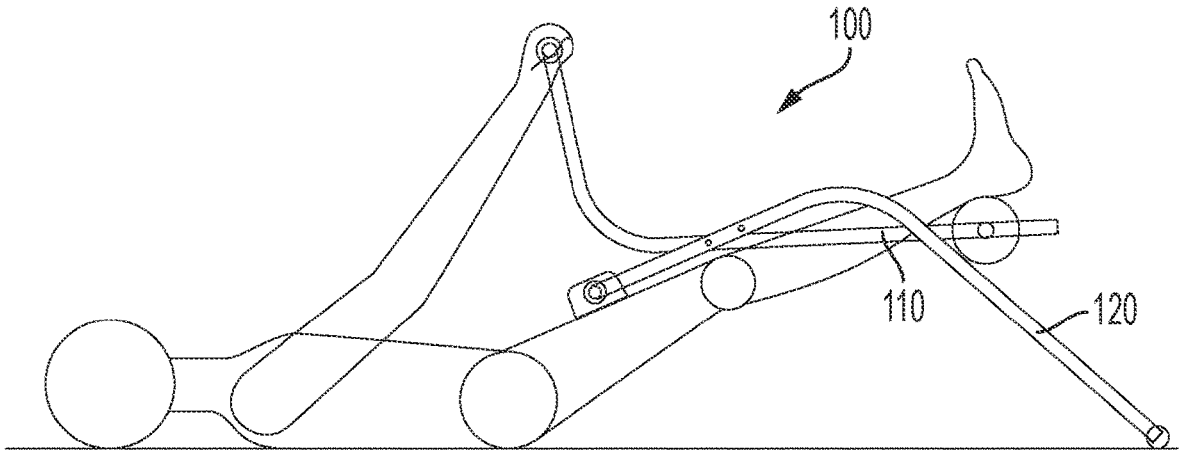
FIG. 5 is a side elevational view of a pivoting lower limb therapy device built in accordance with an embodiment of the present invention shown with a supine user and its lever frame in a mid position.
Figure 6:
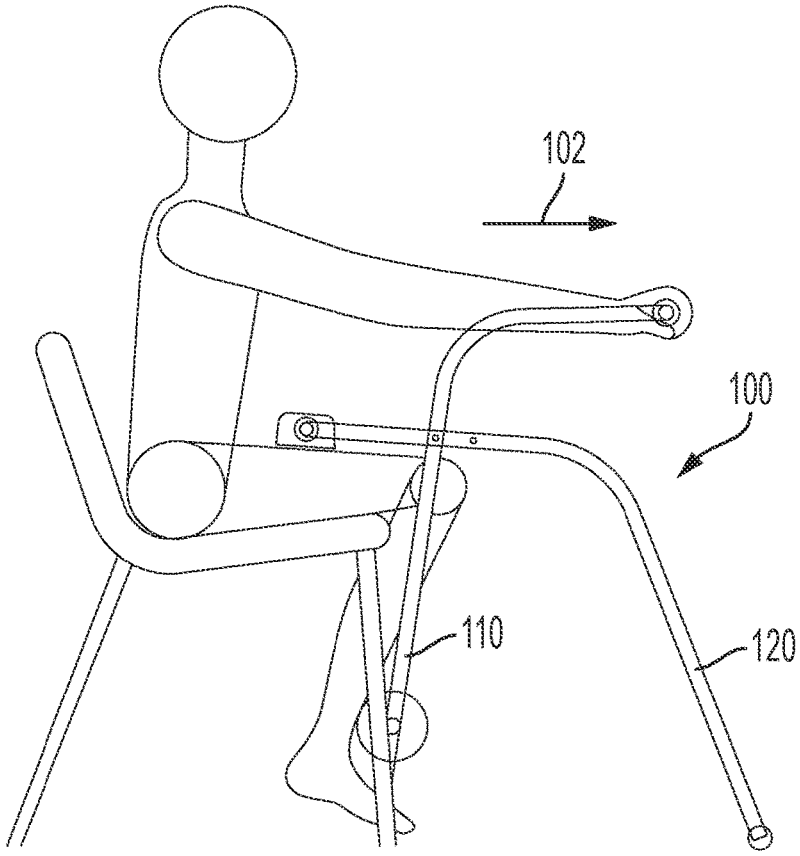
FIG. 6 is a side elevational view of a pivoting lower limb therapy device built in accordance with an embodiment of the present invention shown with a seated user and its lever frame in a lower position and the user's leg behind the lever frame.

Described herein is a pivoting lower limb therapy device which enables the break down scar tissue through a series of mechanical stretches, provides for the performance of rehabilitation exercises similar to those used by the therapist, and provides for passive and active motion therapy, including active resistive actions (isotonic) as well as active/rest/passive actions (contract relax therapy). The pivoting lower limb therapy device described herein employs two generally L-shaped frames, which may be formed from bent tubes and which are pivotally coupled. The two tube frames together are arranged and oriented to allow the application of static or dynamic force to a patient's limb which may be used to stretch contracted tissue and increase limb flexion and extension range of motion, particularly at extension.

Referring now to the drawings and, in particular, FIGS. 1, 2, 3, 4*a*, 4*b*, 4*c*, 5, and 6, a pivoting lower limb therapy device 100 is shown having a lever frame 110 that is connected to a base frame 120 at a pair of pivot joints 130. The generally L-shaped lever frame 110 provides a U-shaped lever handle portion at a proximal end and a lower leg resting portion adjacent to a distal end, with a bend positioned there between, and may be formed by two elongated members running in parallel and connected by the lever handle portion at one end and the lower leg resting portion at the other end. The generally L-shaped base frame 120 includes a U-shaped upper leg portion at a proximal base end and a base stand portion at a distal base end, with a base bend positioned there between, and also may be formed by two elongated base members running in parallel and connected by the upper leg portion at one end and the distal base end at the other end. The pivot joints 130 each include an elongated pivot member 131 which may be formed of a cylindrical rod. The elongated pivot members 131 each pass through or is otherwise integrated with the lever frame 110 and base frame 120 at the location of the pivot joints 130, forming an axis about which the lever frame 110 and base frame 120 can rotate relative to one another.

The lever handle portion may be defined by a padded handle member 111 and the lower leg resting portion may be defined by a lower leg orthotic pad 112.

The upper leg portion may include an upper leg orthotic 121 and the base stand portion may be defined as a surface support member 122.

The lever frame 110 is moveably connected to the base frame 120 at the pivot joints 130, with the elongated member on the left side of the lever frame 110 attached to the elongated base member on the left side of the base frame by a left pivot joint 130 and the elongated member on the right side of the lever frame 110 attached to the elongated base member on the right side of the base frame by a right pivot joint 130. The pivot joints are aligned such that together, they form a pivot axis about which the lever frame 110 and the base frame 120 can rotate about one another. The pivot joints 130 may be located on the base frame 120 between the upper leg orthotic 121 and the base bend and on the lever frame 110 between the bend and the lower leg orthotic pad 112.

As the lever frame 110 is oriented such that its length from bend to the padded handle member 111 extends away from the base frame. Through this design, when the lever frame 110 is pulled in a body direction 101, which in effect is towards the body of a person using the pivoting lower limb therapy device 100, it lifts lower leg of the person that is positioned on the lower leg resting portion. The force required to lift the lower leg is applied thru pivot axis and simultaneously presses down on the upper leg orthotic 121. Through this action, the lever frame 110 and the base frame 120 combine to provide two opposing forces on a user's leg, one above and one below the knee.

When the pivoting lower limb therapy device 100 is in place on a user, it is contemplated that the greater the lifting force applied through the lever frame 110, the greater the force pressing down on the thigh is generated, the greater the force applied on the affected limb in order to break down scar tissue and help regain full range of motion. Passive motion of the lower leg may be achieved by pulling on the lever frame 110 in the body direction 101 while relaxing the lower leg. On the other hand, active motion of leg is achieved when leg attempts to move (self-propelled) while the lever frame 110 is used to provide resistive force opposing the motion created by the lower leg.

In this regard, the two part frame of the pivoting lower limb therapy device 100 may be used to achieve knee extension and flexion with static or dynamic force by mobilizing a joint of patient's lower limb (i.e., the knee). The lever frame 110 is adapted for connection to a portion of a patient's limb, namely below the knee, on a first side of the limb, namely the rear of the leg, through the lower leg orthotic pad 112. The base frame 120 is adapted for placement on a second portion of the patient's limb, namely above the knee, on a second side of the limb, namely the front of the leg, through the upper leg orthotic 121. The lever frame 110 has a proximal radius bend that provides a handle member 111 that allows a patient to push or pull to create a lever moment between the lever frame 110 and the base frame 120 that acts on a surface above the patient's knee in front of their leg and on a surface below the patient's knee on the rear of the leg. The lever frame 110 is connected to the base frame 120 in a location that causes the patient's leg, when in place in the pivoting lower limb therapy device 100 to be elevated relative to the surface support member 122 which may be resting on the ground, meaning the leg may move freely without contacting the ground. In this regard, the lever frame 110 provides lever controlled knee extension rehabilitation motion control from either a sitting or prone position.

The upper leg orthotic 121 and the lower leg orthotic pad 112 may each be rotatable around the circumference of the base frame 120 and lever frame 110, respectively, forming force absorbing pivoting orthotic members which can provide anatomical independent suspension of the patients first and second portion of their leg.

Advantageously, the pivoting lower limb therapy device 100 provides two independent moving pressure-reducing orthotics that distribute the large forces generated by the patient when the lever frame 110 is activated by pulling back in the body direction 101 or pushing forward in an outer direction 102. One pivoting pressure reducing orthotic is defined by the upper leg orthotic 121 which may be positioned on the pivoting lower limb therapy device 100 so that it can be placed against a portion of a user's limb above the user's knee. The upper leg orthotic 121 may be defined by a padded member that is curved to contour to the front surface of a user's thigh and is connected to the base frame 120 by means of a pivot bracket 123. The pivot bracket 123 rotatably coupled with the base frame 120, allowing it to rotate around the center of the "U" shaped proximal end of the base frame 120 as a user positions the pivoting lower limb therapy device 100 on their leg and engages in therapy exercise. The pivot bracket 123 allows the upper leg orthotic 121 to self-align with a user's thigh regardless of the angle of the base frame 120. The pivot bracket 123 may be kept in the center of the proximal end of the base frame 120 by way of a locating screw and a concave bushing acting as an anchor in the area where the pivot bracket 123 is connected to the base frame 120.

The second pivoting pressure reducing orthotic may be defined by the lower leg orthotic pad 112 which may be positioned on the pivoting lower limb therapy device 100 so that it can be placed against a portion of a user's limb beneath the user's knee. The lower leg orthotic pad 112 may be defined as a foam roller pad positioned over a rigid cross member tube 113. The cross member tube 113 is movably coupled with the lever frame 110, having at each end an aperture size to receive portions of the lever frame 110 to allow the cross member tube 113 to slide up and down the lever frame 110. This allows for the position of the so as to be adjusted to the patients' leg length. The position of the lower leg orthotic pad 112 may be controlled with a pair of clamp style adjustment collars 114 which are attached to the lever frame 110. The adjustment collars 114 may be loosened in order to allow them to be slid into a desired place on the lever frame 110 and then tightened to be locked into that place. Generally, the desired place would be a location below which the user does not want the cross member tube 113 to slide.

The upper leg orthotic 121 may be coupled with the pivot bracket 123 by being fastened using rivets, screws, bolts or any other means of forming a rigid attachment. The pivot bracket 123 and the cross member tube 113 each provide apertures with an accompanying grommet that rotatably couple them with base frame 120 and the lever frame 110, respectively, to allow the pressure reducing orthotics to pivot and rotate in relation to the frames and self-align with the anatomical shape two distinct portions of a user's limb.

It is contemplated that each of the pressure-reducing orthotics may also or alternatively be secured by means of straps (static or dynamic) that encircle the corresponding portions of the patient's limb.

The pivoting lower limb therapy device 100 can apply force by being activated various ways using the lever frame 110. A user with their leg in place therein can pull back, pull back and lift, pull back and press down, or push forward to apply force in various directions. Along with various ways to apply force, there are various positions the pivoting lower limb therapy device 100 can be positioned to when applying force. The user can be laying down on the floor, therapy table, or bed. The user could alternative be sitting in a chair or standing. The unique shape of the base frame 120 provides a stable structure in the surface support member 122 that can be used to rest on the floor, therapy table, or bed. The surface support member 122 may have a protective end cap to provide protection to the surface that supports them. The location of attachment of the lever frame 110 to the base from, along with the surface support member 122, operate to raise the base frame 120 at an angle so a user's limb will be elevated. The elevation creates space under the user's limb (which may be the leg). Also, it is appreciated that the upper leg orthotic 121 allows for a large force can be applied without discomfort to a user when the user is pressing down on the lever frame 110.

The base frame 120 may have three (3) pairs of holes for use as pivot joints 130 to allow the lever frame 110 to be set in a relative position with respect to the base frame 120 to match the knee axis of the patient.

Figure 7:
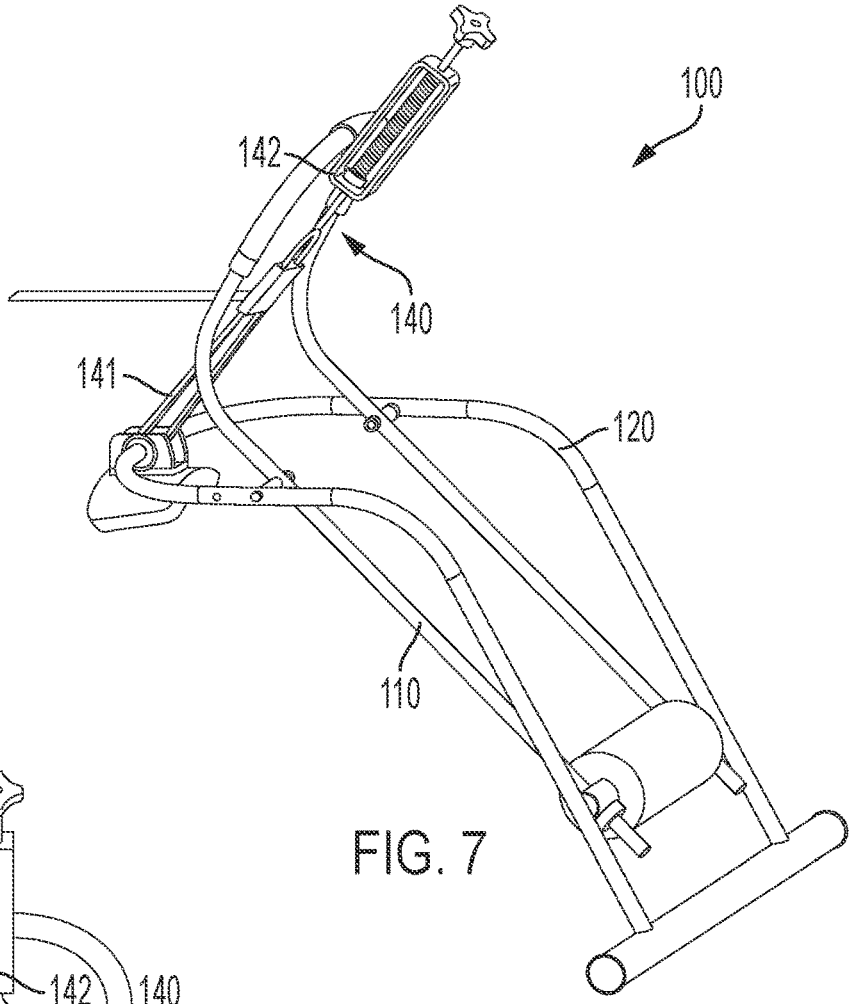
FIG. 7 is a side perspective view of a pivoting lower limb therapy device built in accordance with a strapped embodiment of the present invention shown with its lever frame in a lower position.
Figure 8:
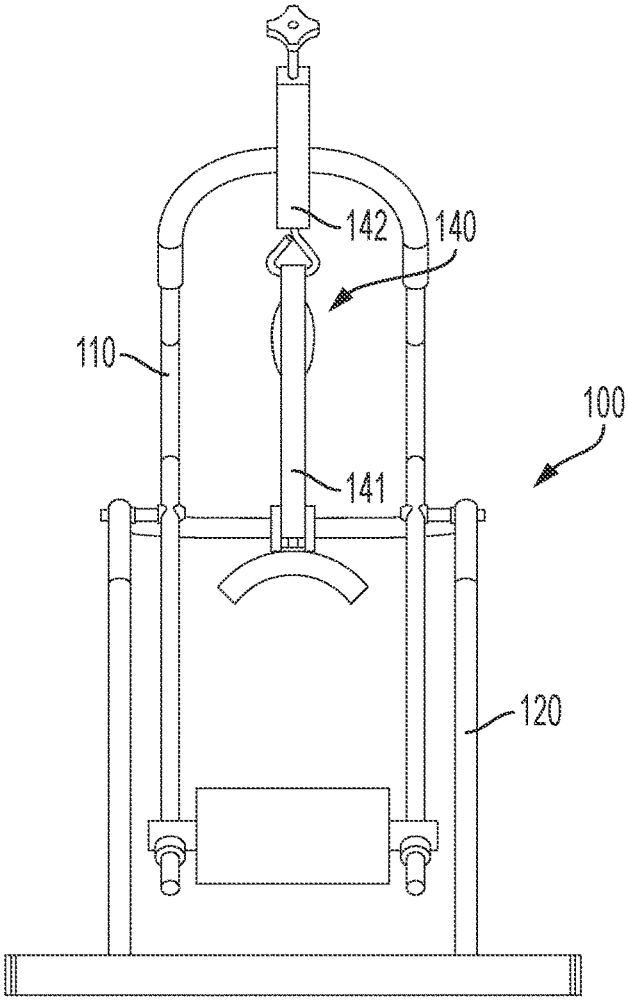
FIG. 8 is a rear elevational view of a pivoting lower limb therapy device built in accordance with a strapped embodiment of the present invention shown with its lever frame in a lower position.

Referring now to FIGS. 7 and 8, the pivoting lower limb therapy device 100 may also be set to operate similar to a mechanical stretching device through an integration with a strap assembly 140. Mechanical stretching devices are generally categorized as (1) dynamic low-load prolonged duration stretch devices ("LLPS") or (2) static progressive ("SP") stretch devices (i.e., splint). LLPS devices permit resisted active and passive motion (elastic traction) within a limited range. SP stretch devices hold the joint in a set position but allow for manual modification of the joint angle (inelastic traction).

The strap assembly 140 includes a strap 141 that is connected to the proximal end of the lever frame 110 and to the proximal end of the base frame 120. The strap assembly 140 may operate to hold the frames in a set position relative to one another by resisting force that would pull the proximal end of the lever frame 110 away from the proximal end of the base frame 120 when the strap 141 is defined by a static strap. The strap assembly 140 may alternatively operate to exert force on the proximal end of the lever frame 110 and the proximal end of the base frame 120 that pulls them together when the strap 141 is defined by a dynamic strap. As such, the pivoting lower limb therapy device 100 can operate in both passive and active modes and allows for both dynamic and static stretches depending on whether device is used with a static strap or a dynamic strap with the strap assembly 140.

The strap assembly 140 may include a tension member 142 that is attaches to the top center of the proximal end of the lever frame 110 and connects the strap 141 thereto. The tension member 142 includes a threaded adjuster connected to a strap connector such that rotating the threaded adjuster moves the strap connector either closer to or further from the base frame 120. As such, when the strap 141 is attached to the strap connector at one end and the base frame 120 at the other end, the strap assembly 140 is configured to exert a compression force on the proximal end of the lever frame 110 and the proximal end of the base frame 120 that pulls them together. Such a force would naturally apply tension to the strap.

The strap 141 may also include a buckle and have an active portion (the portion that extends between the base frame 120 and the strap connector) that is adjustable in length.

With a static strap, which may be substantially fixed in length and not substantially elastic, such as a nylon strap, this action can be used to activate extension of the leg and hold the position of the leg in a static position for as long as is prescribed by the medical provider. When the time has been reached the user can use the tension member 142 to decrease the compression force and allow the leg to return to its natural resting position. The repeat exercise as instructed by therapist.

With the dynamic strap, which may be constructed of or otherwise includes an elastic aspect such as rubber to give it spring like qualities, its spring like quality itself can produce tension in the form of pulling the proximal end of the lever frame 110 and the proximal end of the base frame 120 together the along the length of the strap. It can be used to activate extension of the leg position of the leg in a dynamic position for as long as is prescribed by the medical provider. The tension can be increased by using the tension member 142 and/or adjusting the length of the strap to making the strap shorter and placing more tension along the strap. But even when the strap position is fixed, the strap through its spring like quality continues to apply a force to the leg in an attempt to extend it. As the stiffness in the leg joint is reduced over time by the dynamic strap, the leg extends further and the tension in the strap is reduced. This process of applying tension and the leg motion occurring is dynamic therapy. Releasing the tension will allow the leg to return to its natural resting position.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A pivoting lower limb therapy device, comprising:

a first frame member having a proximal end and a distal end, wherein said first frame member includes a handle portion integral with the proximal end and a first orthotic portion adjacent to the distal end;

a second frame member having a proximal frame end and a distal frame end, wherein the second frame member includes a second orthotic portion integral with the proximal frame end and a surface support portion integral with the distal frame end;

wherein said first frame member is movably attached to the second frame member so as to permit the first orthotic portion to move across two dimensions relative to the second orthotic portion in response to an exertion of mechanical force on the handle portion; and wherein said second frame member is defined by a base frame, the proximal frame end includes a second U-shaped portion of the base frame, and the second orthotic portion includes a curved padded member.

2. The pivoting lower limb therapy device of claim 1, wherein said first frame member is defined by a lever frame, the proximal end is includes by a first U-shaped portion of the lever frame, and the first orthotic portion is defined by a cylindrical pad.

3. The pivoting lower limb therapy device of claim 2, wherein the cylindrical pad is rotatably connected to the lever frame.

4. The pivoting lower limb therapy device of claim 1, wherein said first frame member is defined by a lever frame that includes a proximal elongated portion adjacent to the proximal end and a distal elongated portion adjacent to the distal end, with the proximal elongated portion and the distal elongated portion oriented on intersecting planes.

5. The pivoting lower limb therapy device of claim 4, wherein the proximal elongated portion of said first frame member is attached to the second frame member.

6. The pivoting lower limb therapy device of claim 1, wherein said second orthotic portion is rotatably connected to the base frame.

7. The pivoting lower limb therapy device of claim 1, wherein said second frame member is defined by a base frame that includes a proximal elongated frame portion adjacent to the proximal frame end and a distal elongated frame portion adjacent to the distal frame end, with the proximal elongated frame portion and the distal elongated frame portion oriented on intersecting planes.

8. The pivoting lower limb therapy device of claim 7, wherein the proximal elongated frame portion of said second frame member is attached to the first frame member.

9. The pivoting lower limb therapy device of claim 1, additionally comprising a strap assembly that is integral with the first frame member and the second frame member.

10. The pivoting lower limb therapy device of claim 9, wherein the strap assembly is connected to and extends between the proximal end of the first frame member and to the proximal frame end of the second frame member.

11. The pivoting lower limb therapy device of claim 9, wherein the strap assembly is configured to at least one of resist force acting to pull the proximal end of the first frame member away from the proximal frame end of the second frame member and exert force that pulls the proximal end of the first frame member towards the proximal frame end of the second frame member.

* * * * *